US006877604B2

(12) United States Patent
Pratt et al.

(10) Patent No.: US 6,877,604 B2
(45) Date of Patent: Apr. 12, 2005

(54) ERGONOMIC GOLF BAG TOP AND CLUB SEPARATOR

(75) Inventors: Michael James Pratt, Draper, UT (US); Joseph W. Christensen, Cedar Hills, UT (US); Scott Kendrick Warner, Provo, UT (US); Jeffrey Alan Sheets, Sandy, UT (US)

(73) Assignee: Ogio International, Inc., Bluffdale, UT (US)

( * ) Notice: Subject to any disclaimer, the term of this patent is extended or adjusted under 35 U.S.C. 154(b) by 0 days.

(21) Appl. No.: 10/272,224

(22) Filed: Oct. 16, 2002

(65) Prior Publication Data

US 2004/0074792 A1 Apr. 22, 2004

(51) Int. Cl.[7] ..... A63B 55/00

(52) U.S. Cl. ..... 206/315.6; 206/315.3; 211/70.2

(58) Field of Search ..... 206/315.3, 315.6; 211/70.2; 280/DIG. 6

(56) References Cited

U.S. PATENT DOCUMENTS

| | | | | | |
|---|---|---|---|---|---|
| 936,698 | A | * | 10/1909 | Breakspear | 206/315.6 |
| 1,434,621 | A | * | 11/1922 | Marwood et al. | 206/315.6 |
| 1,849,610 | A | * | 3/1932 | Boyce | 206/315.6 |
| 2,436,687 | A | * | 2/1948 | Corbett | 206/315.6 |
| 2,534,096 | A | * | 12/1950 | Zapoleon | 206/315.6 |
| 2,763,309 | A | * | 9/1956 | Jones | 206/315.6 |
| 3,460,597 | A | * | 8/1969 | Daly | 206/315.4 |
| 4,055,207 | A | | 10/1977 | Goodwin | 150/1.5 R |
| 4,200,131 | A | | 4/1980 | Chitwood et al. | 150/1.5 R |
| 4,667,820 | A | * | 5/1987 | Solheim | 206/315.6 |
| 4,834,235 | A | * | 5/1989 | Solheim et al. | 206/315.7 |
| 5,042,703 | A | * | 8/1991 | Izzo | 224/643 |
| 5,071,147 | A | * | 12/1991 | Stansbury | 280/47.19 |
| 5,099,990 | A | * | 3/1992 | Antonious | 206/315.6 |
| 5,103,974 | A | * | 4/1992 | Antonious | 206/315.6 |
| 5,228,566 | A | | 7/1993 | Shenoha | 206/315.6 |
| 5,431,278 | A | * | 7/1995 | Gretz | 206/315.6 |
| 5,624,028 | A | * | 4/1997 | Shin et al. | 206/315.6 |
| D390,361 | S | * | 2/1998 | Wu | D3/320 |
| 5,816,397 | A | * | 10/1998 | Pratt | 206/315.6 |
| 5,860,520 | A | * | 1/1999 | Tang | 206/315.6 |
| 5,911,322 | A | * | 6/1999 | Lombardo et al. | 206/315.3 |
| 5,918,737 | A | * | 7/1999 | Kwon | 206/315.3 |
| D431,111 | S | * | 9/2000 | Ryan | D3/320 |
| 6,341,690 | B1 | * | 1/2002 | Swiatosz | 206/315.6 |
| 6,427,835 | B1 | * | 8/2002 | Chang | 206/315.6 |
| 6,598,743 | B1 | * | 7/2003 | Puskaric | 206/315.6 |

FOREIGN PATENT DOCUMENTS

| | | | | |
|---|---|---|---|---|
| WO | WO96/14111 | * | 5/1996 | 206/315.6 |

* cited by examiner

*Primary Examiner*—Sue A. Weaver
(74) *Attorney, Agent, or Firm*—Kirton & McConkie; Michael F. Krieger

(57) ABSTRACT

The present invention features a ergonomically designed and structured golf bag top and club separator. The golf bag top and club separator comprises a perimeter support member having integrally formed tiered sections both along its longitudinal and lateral axes, a wood complex, an iron complex located opposite from and offset below the wood complex, and a plurality of strategically placed dividers therein to provide vertical disposition and segregation of wood-type golf clubs. Through its unique design, the present invention provides vertical segregation of the wood complex, thus providing optimal positioning, travel, access, and retrieval of golf clubs inserted and housed therein, as well as providing added protection of the clubs from one another. The wood complex is vertically segregated and positioned proximate or distal the body of the user.

9 Claims, 8 Drawing Sheets

Fig. 7

ERGONOMIC GOLF BAG TOP AND CLUB SEPARATOR

BACKGROUND

1. Field of the Invention

The present invention relates to golf bags and golf bag top designs, and particularly to a more ergonomically designed golf bag top and club separator attachable to or integrated with the body of a golf bag that allows for more efficient club orientation, greater club protection, and an ergonomic design that provides more efficient access and retrieval of the golf clubs housed therein.

2. Background of the Invention and Related Art

Many golf bags include a top member or club separating device, which includes one or more partitions to both separate clubs and provide organization so that clubs can be more easily located when needed. A plurality of golf clubs is typically inserted into each partitioned area shaft first, with the heads of the golf clubs protruding from the top of the golf bag. The partitioned compartments holding these shafts are simple designs that allow the heads of the clubs in each compartment to shift about as the bag is carried, dropped, or lifted by a golfer or a caddie. The club heads thereby become disorganized, and contact between the heads and shafts can cause the heads to become scratched or the shafts to be dented. In addition, many of the club separating devices are not ergonomically friendly to the golfer or other user in that their design configuration and layout make the task of accessing and retrieving the golf clubs difficult. It is not uncommon for golf clubs to come in contact with and interfere with one another, making it difficult to remove the club from the golf bag.

Some efforts have been made to incorporate devices for retaining individual club heads in a fixed position so that the club heads remain organized and do not contact each other. For example, U.S. Pat. No. 4,055,207 describes a club retainer which is molded from resilient material and which includes wedge-shaped notches. The club heads are releasably clamped within the notches.

U.S. Pat. No. 4,200,131 describes a first embodiment that includes a flat top surface and a plurality of inclined surfaces that extend upwardly from the top surface for supporting the faces of the club heads. Each inclined surface extends at an angle corresponding to the loft angle of a particular number of clubs, so each club must be inserted into the proper place. A second embodiment is provided with indentations. The shape of each indentation is designed to accommodate a club having a particular loft angle.

U.S. Pat. No. 5,228,566 provides a golf bag top and club separator that includes two rows of staggered slots for retaining the heads of golf clubs. Each slot includes a flat bottom surface for supporting the top edge of a club head, an inclined side surface for guiding the club head to the bottom surface, and an upwardly extending side surface that provides a stop for retaining the club head on the bottom surface. Although each slot is advantageously associated with a particular club, the slots do not provide a wedging action, and each slot has substantially the same shape. It is therefore not necessary to insert a particular club head into a particular slot, and the club separator can be used with clubs from different manufacturers. The two rows of staggered slots distribute the weight of the clubs to provide good balance. This design suffers in that it is difficult for a golfer to reach between the several clubs and retrieve the desired club, thus decreasing the ergonomics of the golf bag.

SUMMARY AND OBJECTS OF THE INVENTION

In light of the prior art deficiencies discussed above, the present invention seeks to provide a more efficient means for housing and positioning golf clubs within a golf bag, as well as providing a more efficient way to access and retrieve these golf clubs from an ergonomic standpoint, especially during a round of golf. Therefore, in accordance with the invention as embodied and broadly described herein, the present invention features an ergonomically designed golf bag top and club separator.

In a preferred embodiment, the golf bag top and club separator comprises: (a) a perimeter support member having a contoured profile and periphery so as to provide optimal wood and iron separation as well as optimal ergonomic club access; (b) a wood complex for housing wood-type golf clubs, wherein the wood complex is oriented to one side of a vertical bisector, oriented parallel to the user when in use so as to allow wood-type golf club placement and positioning therein along a continuum, the wood complex parallel to the user comprising a plurality of wood dividers therein to define a plurality of wood compartments. An iron complex for housing iron-type golf clubs is located on the other side of the vertical bisector, wherein the iron complex is positioned opposite of the wood complex, the iron complex comprising a plurality of iron dividers therein to define a plurality of iron compartments. A wood/iron partition separating the wood complex from the iron complex is aligned along a generally parallel axis to the user, the partition reducing the opportunity for contact between any iron-type golf clubs housed within the iron complex and any wood-type golf clubs housed within the wood complex. The present invention further features a putter complex wherein the putter complex comprises a putter divider separating the putter complex from either the wood complex, the iron complex, or both.

Other embodiments are also contemplated and provided for herein. In another embodiment, the golf bag top and club separator comprises an elevated profile with the dividers and the perimeter support member being contoured and at different elevations. In yet another embodiment, the golf bag top and club separator comprises a wood and an iron complex defined by a series of dividers, each comprising a rise therein to provide an elevated portion (the wood complex) and a lower portion (the iron complex).

Still in another embodiment, the golf bag top and club separator comprises a perimeter support member having an iron complex situated therein, and a wood complex positioned or situated without or outside the perimeter support member. The wood complex is still vertically segregated (along an axis parallel to the user) and allows the wood complex to be further separated from the iron complex.

In each of the embodiments discussed herein, it is emphasized that the wood and iron complexes are always separated so that all of the woods are either close to the user (proximal) or all away from the user (distal). Situating the wood complex in a distal position has several advantages including, easier access and retrieval of both iron and wood-type golf clubs placed within the golf bag and more ergonomically correct positioning for carrying.

As a result of the strategic design of the perimeter support member, the wood complex can situate the wood-type golf clubs away from the body of the user at all times. Stated another way, the wood complex of one embodiment of the present invention is positioned within the golf bag top and club separator so that the wood-type golf clubs are always inserted and stored within the golf bag at a location distal the body of the user. In addition, the wood complex provides for vertical segregation, or are vertically segregated, rather than horizontal segregation as found in most prior art designs. In addition, the relative placement of the wood complex with respect to the iron complex reduces interference between the woods and irons. Moreover, because there is less contact between these two types of clubs, there is less chance for the clubs to become scratched, dented, or otherwise damaged.

Finally, in another embodiment, the perimeter support member may comprise multiple-levels in both its longitudinal and lateral directions. In addition to these multiple levels, the perimeter support member comprises a perimeter rise allowing the perimeter support member to comprise a lower profile, and to accommodate the positioning of the wood complex and iron complex. This perimeter rise also exposes a greater portion of the golf clubs housed within the golf bag, thus making it easier for the golfer to access and retrieve the golf clubs.

The present invention golf bag top and club separator may be implemented into any style golf bag with little or no modification, including both carry-type golf bags as well as golf bags designed to be carried on carts.

BRIEF DESCRIPTION OF THE DRAWINGS

In order that the manner in which the above-recited and other advantages and features of the invention are obtained, a more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
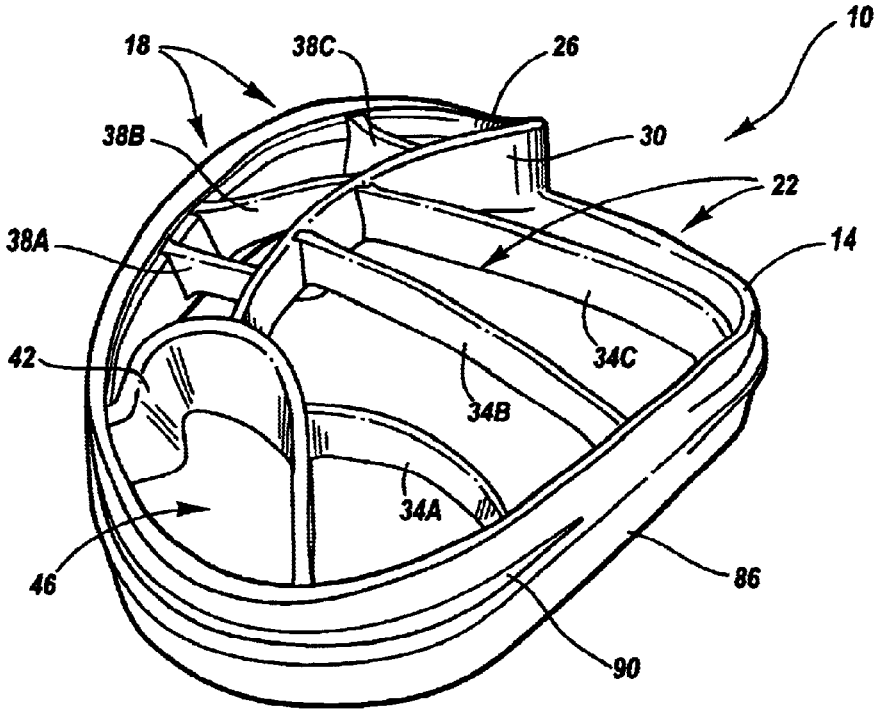
FIG. 1 illustrates a perspective view of the golf bag top and club separator according to one embodiment of the present invention.

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 11, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention comprises an apparatus for ergonomically orienting or positioning one or more, and preferably a plurality of, golf clubs within a golf bag so that they are arranged to enable optimal access and retrieval by the user. Specifically, the present invention comprises a golf bag top and club separator ergonomically designed so as to provide more efficient club storage or orientation within the golf bag, as well as to provide more attainable access to such clubs by the user during a round of golf. The golf bag top and club separator focuses on the vertical segregation of the wood-type golf clubs through the positioning of the complex designed to receive and house these types of clubs. As used herein, the term "vertical" means that the woods and irons are divided by a wall that partitions the clubs so that all of the woods are placed either next to the user when carrying the bag or away from the user. The clubs are positioned in compartments much like stadium seating, arranged along a line substantially parallel to the user.

With reference to FIGS. 1–6 and 8–10, an ergonomic golf bag top and club separator 10 (hereinafter referred to as "club separator 10") is shown. Club separator 10 is designed to function similar to prior art club separator devices in that it is coupled to the top or upper portion of a golf bag and serves as the rigid structure that defines the upper opening of the golf bag. However, unlike prior art club separator devices, the present invention club separator 10 comprises a unique ergonomic design and layout that functions to provide optimal club placement as well as club protection within a golf bag. A number of strategically positioned and oriented dividers within perimeter support member 14 are provided. Golf bag top and club separator 10 may further comprise a golf bag insert 86 extending from perimeter support member 14 that may be inserted into a top opening of a golf bag allowing golf bag top and club separator 10 to be secured within the golf bag, and a stopper 90 protruding from insert member 86 for ensuring proper positioning of golf bag top and club separator 10 within the golf bag. In an exemplary embodiment, stopper 90 engages an upper lip portion of an upper opening of a golf bag to ensure correct positioning of golf bag top and club separator 10 within the golf bag.

Specifically, club separator 10 comprises a wood complex 18 and a complimentary iron complex 22 positioned adjacent wood complex 18 within perimeter support member 14. Wood complex is vertically segregated and positioned along one of the sides of club separator 10. In other words, wood complex 10 is vertically segregated so that it is either proximate or distal the user, depending upon the configuration desired.

Club separator 10 also comprises a putter complex 46, which provides a separate and distinct area of space within perimeter support member 14 from each of wood complex 18 and iron complex 22. Putter complex 46 typically is designed to be positioned at the front of club separator 10, but may also be located or positioned at any location.

Figure 4:
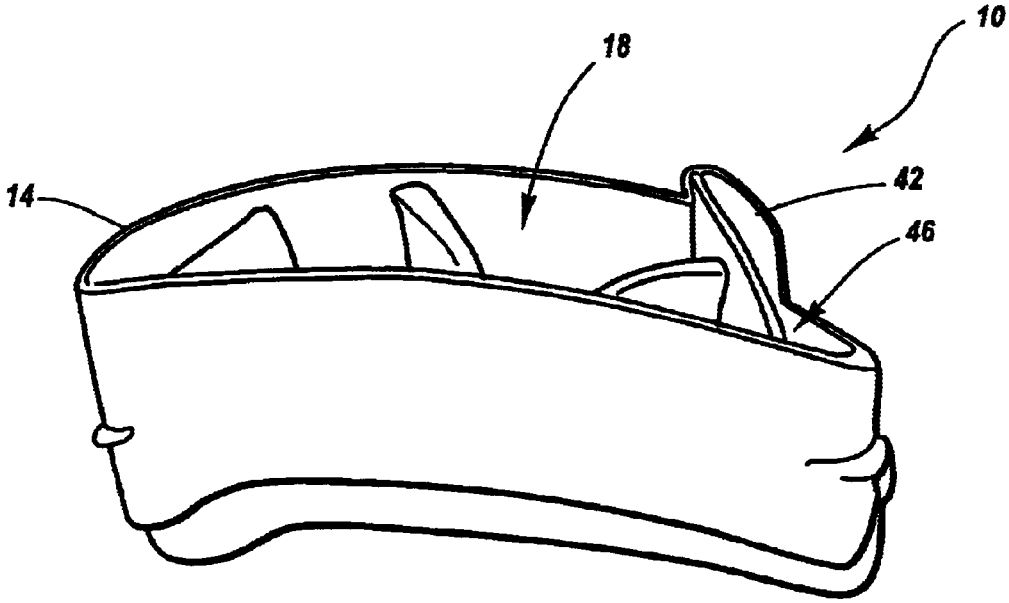
FIG. 4 illustrates a first side view of the golf bag top and club separator showing the wood complex according to one embodiment of the present invention.

In one exemplary embodiment, shown in FIG. 1, wood complex 18 is an elevated wood complex, wherein it comprises a planar orientation that is above or higher than iron complex 22 when looking at a side view of club separator 10, as shown in detail in FIG. 4. Wood complex 18 is bound on one side by perimeter support member 14 and on another side by a wood/iron partition 26 used to separate wood complex 18 from iron complex 22. In this embodiment, wood/iron partition 26 extends above the upper most part of the perimeter support portion, such that wood complex 18 and iron complex 22 comprise opposing angular planes, respectively, which meet to form an apex at the wood/iron partition. Wood complex 18 is situated along the side of club separator 10 so that any wood-type clubs inserted and housed therein are proximate the body of the user. Stated another way, wood complex 18 situates any wood-type golf clubs placed therein at a position closer to the body of the user than its iron complex 22 counterpart.

Figure 3:
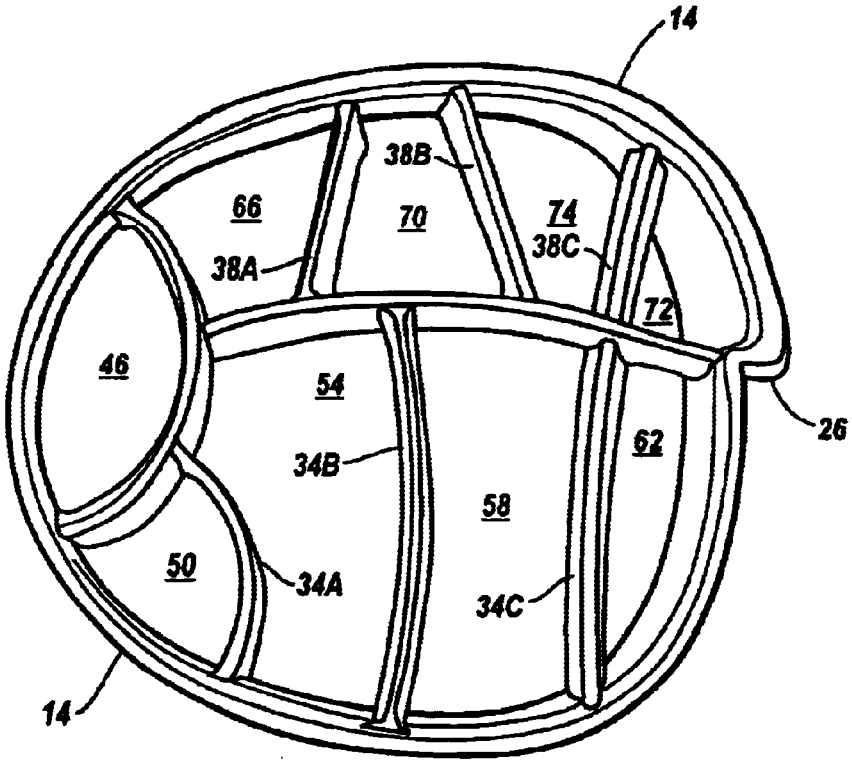
FIG. 3 illustrates a top view of the golf bag top and club separator according to one embodiment of the present invention.

Wood complex 18 is designed to be vertically segregated (from the perspective of a top view of club separator 10, as shown in FIGS. 1 and 3) on or within club separator 10, and particularly perimeter support member 14, meaning that wood complex 18 is situated or positioned on or within perimeter support member 14 along its sides, which allow any wood-type clubs placed and housed therein to also be vertically segregated.

Figure 7:
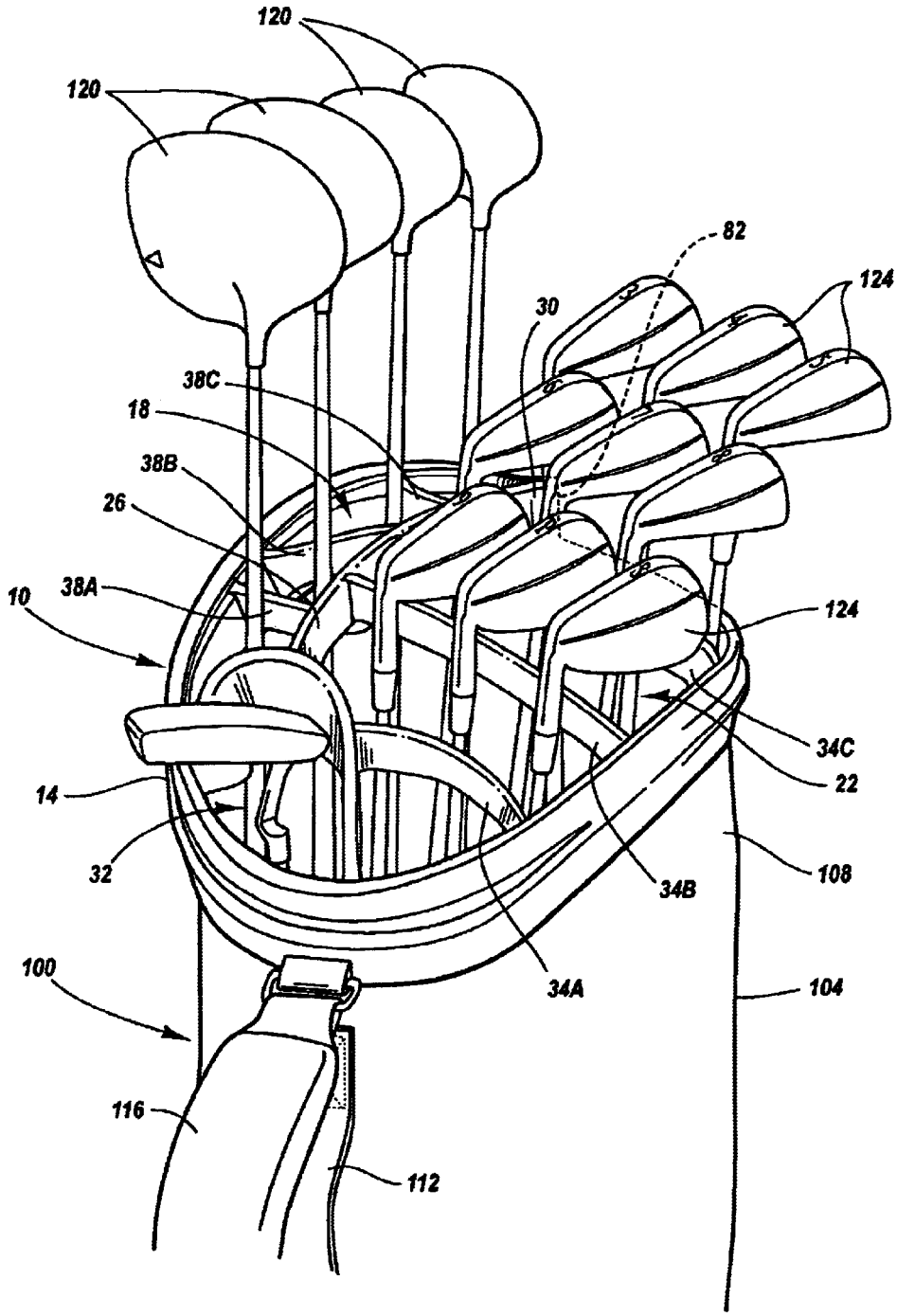
FIG. 7 illustrates the golf bag top and club separator as attached to a golf bag and a plurality of golf clubs oriented or positioned and ergonomically accessible therein according to the concepts of the present invention.

Providing a wood complex proximate the body of the user, as well as providing vertical segregation of wood complex 18, has several advantages. First, it is easier to locate, grasp, and retrieve any wood-type golf clubs housed therein because there is less interference with other clubs and the user is able to better reach the clubs. Second, when utilized in a carrying-type golf bag, this particular positioning of wood complex 18 within club separator 10 allows the user to more easily and efficiently access and retrieve a wood-type golf club because it facilitates a more natural extension of the arm and hand. Third, also when utilized in a carrying-type golf bag, the user is able to access wood-type golf clubs while receiving minimal or no interference from iron-type golf clubs. Vertical segregation of wood complex 18 remains in tact during the lifting, carrying, and positioning (if a stand bag) of the golf bag. These advantages are realized due to the natural suspended orientation of the golf bag and club separator 10 when it is being carried by the user (see FIG. 7 showing golf bag and club separator).

Wood/iron partition 26 comprises a protective ridge 30, having a drop face formed therein, allowing wood complex 18 to be positioned slightly higher than iron complex 22. Protective ridge 30 functions to protect the wood-type golf clubs from coming into contact with the iron-type golf clubs if they are housed within the golf bag. Specifically, as will be shown in FIG. 7, wood/iron partition 26, and particularly protective ridge 30, prevents the club head portion of the iron-type golf clubs from breaching the area effectively defined by wood complex 18. In this way, the club head portion of the iron-type golf clubs housed within iron complex 22 is prohibited from coming in contact with the shaft portion of the wood-type golf clubs housed in wood complex 18 (see FIG. 7). Wood/iron partition 26 serves as a physical barrier between the wood-type golf clubs and the iron-type golf clubs as placed within their respective locations.

Wood complex 18 further comprises a series of wood dividers 38, shown as 38-A, 38-B, and 38-C, used to separate a plurality of wood-type golf clubs that are positioned within wood complex 18. As is apparent from each of FIGS. 1–3, wood dividers 38 form alternating angles from one another, as well as perimeter support member 14 and wood/iron partition 26. These angles may be any appropriate angle between 0 and 45 degrees, and are preferably situated at 30 degree angles. As shown, wood divider 38A extends on an angle from a point on perimeter support member 14 located within wood complex 18 to a point on wood/iron partition 26 also within wood complex 18, such that wood divider 38A forms a "high" wood (e.g. 4–5 woods) compartment 66. Similarly, wood divider 38B extends on an opposing angle from a point on perimeter support member 14 located within wood complex 18 to a point on wood/iron partition 26 also located within elevated complex 18, such that wood divider 38B forms a "high to mid" wood (e.g., 3–4 woods) compartment 70. Still similarly, wood divider 38C extends on an opposing angle from wood divider 38B from a point on perimeter support member 14 located within wood complex 18 to a point on wood/iron partition 26 also located within wood complex 18, such that wood divider 38C forms a "mid to low" wood (e.g., 2–3 woods) compartment 74 and a driver compartment 78. This pattern of alternating angled wood dividers allows the wood-type golf clubs housed within the wood complex 18 to equalize at resting positions as far from each other as possible. For example, as a "higher" wood-type golf club (e.g., a five wood) is placed within "high" wood compartment 66, and a "high to mid" wood-type golf club (e.g., a three wood) is placed within "high to mid" wood compartment 70, and a "mid to low" wood-type golf club (e.g., a two wood) is placed within "mid to low" wood compartment 74, and a driver is placed within driver compartment 78, each of these clubs is naturally guided to a resting position within wood complex 18 as far apart from their neighboring club as physically possible. This is accomplished as each of wood dividers 38A, 38B, and 38C come in contact with the shaft portion of the respective clubs placed therein. As each of the wood-type golf clubs are inserted into the golf bag through club separator 10, they are guided to a specific and identified resting position within each of their respective wood compartments 66, 70, 74, and 78, due to the alternating angled nature of wood dividers 38. To further assist the wood-type golf clubs into their proper resting position, wood/iron partition 26 comprises an identified slight or substantial curvature, or curved spline section, in its longitudinal orientation or length as it extends from a first end to a second end of perimeter support member 14, or from a first end of perimeter support member 14, to an intersection with a putter divider 42, as shown. Of course, wood/iron partition 26 may also be comprised of a straight or a substantially straight piece. In the preferred embodiment, however, wood/iron partition 26 comprises a curvature that is convex with respect to wood complex 18 and concave with respect to iron complex 22. In this position, wood/iron partition 26 facilitates the repositioning of the wood/type golf clubs housed within each of their respective wood compartments 66, 70, 74, and 78, by defining and providing for various slopes within these compartments and wood complex 18. Thus, if a wood-type golf club is placed within its respective wood compartment, it is guided into a predefined and specific resting position as a result of its contact, and specifically with the shaft portion of the golf club, with wood divider 38 as well as wood/iron partition 26.

While the alternating angled design of wood dividers 38, in conjunction with the curved design of wood/iron partition 26, function to guide each of the wood-type golf clubs into their specific resting position, these features or elements also function to optimize the path of movement of the wood-type golf clubs that is inevitably experienced while housed or positioned within the golf bag. Thus, as a golfer carries and utilizes the golf bag during a round of golf, club separator 10 is designed to allow optimal movement by the wood-type clubs placed therein as a result of the alternating angled orientation of wood dividers 38 in conjunction with the curved nature of wood/iron partition 26. This is advantageous in that the wood-type clubs placed within their respective wood compartments are only allowed to travel a path specifically defined by each of dividers 38 and wood/iron partition 26 and are bounded on an opposing side by perimeter support member 14. For example, if a high wood, such a five wood, is placed within high wood compartment 66, the shaft of that wood-type golf club will come in contact with one of the boundaries defining high wood compartment 66, in this case perimeter support member 14, putter divider 42, wood divider 38A, and a portion of wood/iron partition 26, as shown in the drawings. If contact is made with wood divider 38A, the wood-type golf club is forced either toward perimeter support member 14 or toward wood/iron partition 26. If forced or guided towards wood/iron partition 26, the wood-type club will further be forced or guided away from "high to mid" wood compartment 70 as a result of the sloped nature of wood/iron partition 26 as existing in "high" wood compartment 66. As a result, no matter the particular movement of the golf bag, the "high" wood-type golf club placed within high wood compartment 66 is only allowed to follow a specific path of movement controlled by the unique design and orientation of the elements comprising the boundaries of high wood compartment 66. Likewise, "high to mid" wood compartment 70, "mid to low" wood compartment 74, and driver compartment 78 each comprise similar structural boundaries designed to control or optimize the path of movement as well as the resting positions of each of the respective wood-type golf clubs placed therein.

Figure 5:
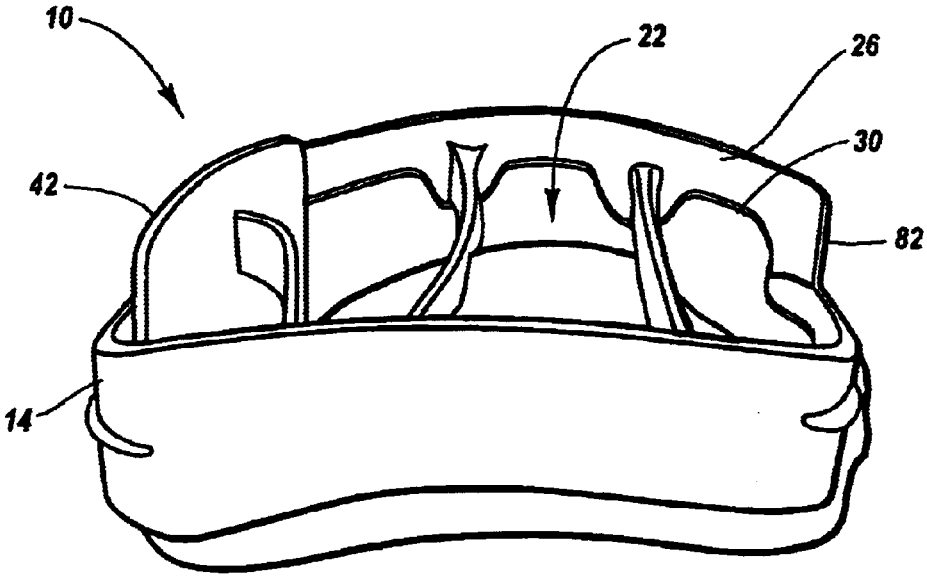
FIG. 5 illustrates a second side of the golf bag top and club separator view showing the iron complex and the wood/iron partition with its associated protective ridge according to one embodiment of the present invention.

One embodiment of the present invention club separator 10 further features and comprises iron complex 22. In one exemplary and preferred embodiment, iron complex 22 comprises a planar configuration that is offset from wood complex 18, such that iron complex 22 is positioned a substantial distance below (or is offset from) wood complex 18, as taken from a side perspective as shown in FIG. 5. Iron complex 22 is contained within perimeters member 14 and has a bounded area substantially defined by perimeter support member 14, wood/iron partition 26, and optional putter divider 42. Iron complex 22 comprises a series of iron dividers 34, namely iron divider 34A, 34B, and 34C. Iron divider 34A functions to physically divide or separate, thus defining respective areas thereof, "high" iron compartment 50 (e.g., nine through wedges) from "high to mid" iron compartment 54 (e.g., six through eight irons). Iron divider 34B functions to divide or separate, as well as helping to define respective areas thereof, "high to mid" iron compartment 54 from "mid to low" iron compartment 58 (e.g., four through six irons). Likewise, iron divider 34C functions to divide or separate "mid to low" iron compartment 58 from "low" iron compartment 62 (e.g., one through three irons), and also helps to define each of these compartments respective areas. Specifically, "high" iron compartment 50 has an area defined by perimeter support member 14, iron divider 34A, and optionally putter divider 42. If putter divider 42 is not present, "high" iron compartment 50 is defined simply by perimeter support member 14 and iron divider 34A. "High to mid" iron compartment 54 has an area defined by a portion of perimeter support member 14, wood/iron partition 26, iron divider 34A, iron divider 34B, and optionally putter divider 42. Again, if putter divider 42 is not present, "high to mid" iron compartment 54 is simply defined by perimeter support member 14, wood/iron partition 26, and iron dividers 34A and 34B. "Mid to low" iron compartment 58 has an area defined by a portion of perimeter support member 14, wood/iron partition 26, and iron dividers 34B and 34C. "Low" iron compartment 62 has an area defined by a portion of perimeter support member 14, wood/iron partition 26, and iron divider 34C.

Each of iron dividers 34A through 34C extend from a point one perimeter support member 14 to a point on wood/iron partition 26 and function to separate any iron-type golf clubs inserted and housed within the golf bag. However, one unique feature of club separator 10 of the present invention is the point of attachment and positioning of iron dividers 34 on to wood/iron partition 26. As mentioned earlier, wood/iron partition 26 functions to prevent or prohibit the club heads of the iron-type golf clubs housed within the golf bag from coming in contact with any portion, and particularly the shaft, of the wood-type golf clubs housed within the golf bag. To accomplish this, wood/iron partition 26 comprises a protective ridge 30 defined by the depth distance of wood/iron partition 26 and the lower placement or positioning of iron dividers 34 intersecting with wood/iron partition 26. Stated differently, each of iron dividers 34A through 34C extend from perimeter support member 14 and join or intersect with wood/iron partition 26 at an identified position, such that protective ridge 30 is formed therein. As the uppermost portion of iron dividers 34A through 34C are offset and positioned on a low plane than the uppermost portion of wood/iron partition 26, a step-like feature is introduced at the intersection of iron dividers 34 and wood/iron partition 26 that is integrally formed with and helps to define protective ridge 30, as well as the drop face contained thereon. Thus, as any iron-type golf clubs are inserted into the golf bag through club separator 10, they are allowed to rotate within their respective iron compartments. However, the existence of wood/iron partition 26, and particularly protective ridge 30, function to prevent any portion of the golf club heads of the iron-type golf clubs from rotating, swiveling, or entering into any portion of the area defined by wood complex 18. Although the club head portion of any iron-type golf club may be allowed to enter into an adjacent iron compartment by rotating over the uppermost portion of any iron divider, these club heads are physically prohibited from entering any portion of wood complex 18 due to the physical contact of the club head portion of the iron-type golf clubs with protective ridge 30. If iron dividers 34 were not offset or positioned at a lower point down the depth distance of wood/iron partition 26, such a feature and function would not be possible. In essence, it is intended that the uppermost portion of wood/iron partition 26 extend above the uppermost portion of any iron divider 34, such that protective ridge 30 may be formed and exist within club separator 10. Such a design allows club separator 10 to comprise a multi-planar design or configuration that functions not only to optimize the placement and path of movement of the golf clubs placed therein, but to increase the physical protection of the golf clubs by substantially eliminating interclub contact.

One embodiment of the present invention golf bag top and club separator further features a unique ergonomic design and configuration not found in prior art golf bag tops and club separators. As stated before, club separator 10 comprises a wood complex 18 and an iron complex 22, defined substantially by perimeter support member 14 and the strategic placement of wood/iron partition 26. With reference to FIG. 4, shown is the side of club separator 10 comprising wood complex 18. As shown, club separator 10, and particularly perimeter support member 14 and wood/iron partition 26, comprises a longitudinal curve, such that the rear or back of club separator 10 is situated higher than the front of club separator 10. This difference in height corresponds directly to the particular placement of each of the iron compartments 50, 54, 58, and 60, as well as the wood compartments 66, 70, 74, and 78. Indeed, "mid to low" iron compartment 58, "low" iron compartment 62, "mid to low" wood compartment 74, and driver compartment 78 are situated in the elevated back or rear section of club separator 10, as the respective wood-like and iron-like clubs designed to be housed within each of these compartments comprise a longer length than their lower numbered club counterparts. Accordingly, "high" iron compartment 50, "high to mid" iron compartment 54, "high wood" compartment 66, and "high to mid" wood compartment 70 are situated in the lower front section of club separator 10. FIG. 4 also illustrates how the top or uppermost portion of wood/iron partition 26 extends above or is elevated above the uppermost portion of perimeter support member 14, thus enabling the function of wood/iron partition 26 as discussed earlier.

In addition to these previously discussed benefits and advantages, the placement or positioning of the top or uppermost portion of wood/iron partition 26 above the top or uppermost portion of perimeter support member 14 allows the user of the golf bag and corresponding club separator to have greater access to the wood-type clubs inserted and housed within wood complex 18. For example, by providing a lower wall member or perimeter support member 14 a greater portion of the shafts of each of the wood-type clubs is exposed, thus making them more readily accessible to the user. Thus, as the user reaches around to grasp a wood-type club, his or her hand freely passes over the uppermost portion of perimeter support member 14 in order to more efficiently grasp and retrieve the desired wood-type club. This specific relative positioning of the divider and corresponding perimeter support member is not found in prior art club separating devices and is more ergonomically friendly or conforming to the user.

FIG. 5 illustrates the side of club separator 10 highlighting iron complex 22. Specifically, FIG. 5 illustrates the pronounced elevation of wood/iron partition 26 with respect to the portion of perimeter support member 14 utilized to help define the area of iron complex 22. As can be seen, not only do iron dividers 34 extend outward from a point on perimeter support member 14 to respective points on wood/iron partition 26, but iron dividers 34 also extend in an upward manner as shown. Similar to the reasoning behind the difference in elevation between wood/iron partition 26 and the portion of perimeter support member 14 located at wood complex 18, the lowering of perimeter support member 14 (or raising of wood/iron partition 26) at the iron complex 22 allows a user of the golf club to more easily and effectively access and retrieve the iron-type clubs housed within one of the iron compartments of iron complex 22. For example, to access and retrieve and iron-type club, a user reaches his or her hand into the are defined by iron complex 22. Due to the offset design configuration between the uppermost portion of perimeter support member 14 and wood/iron partition 26, a greater portion of the iron-type clubs is exposed allowing the user to more efficiently and effectively grasp the desired club of choice.

FIG. 5 also illustrates putter complex 46 as defined by putter divider 42 intersecting with perimeter support member 14 at two locations. While putter complexes are not new in the art, the present invention club separator provides a putter complex having putter divider 42 that also has an uppermost portion that is elevated above each of iron dividers 34, thus functioning to similarly protect and shield a putter that is placed or situated within putter complex 46 from any of the iron-type clubs placed within iron complex 22, as well as the wood-type clubs placed within wood complex 18. Putter complex 46 comprises a similar ridge or face as wood/iron partition 26 in that any of the wood dividers 38 or iron dividers 34 intersecting with the putter divider 42 do so at a lower or offset position so as to create a step or a face that contacts or engages any of the wood or iron-type clubs inserted and housed within the golf bag. Putter complex 46 may be positioned at any location within or without perimeter support member 14, but is preferably positioned within perimeter support member 14 near its front.

Figure 6:
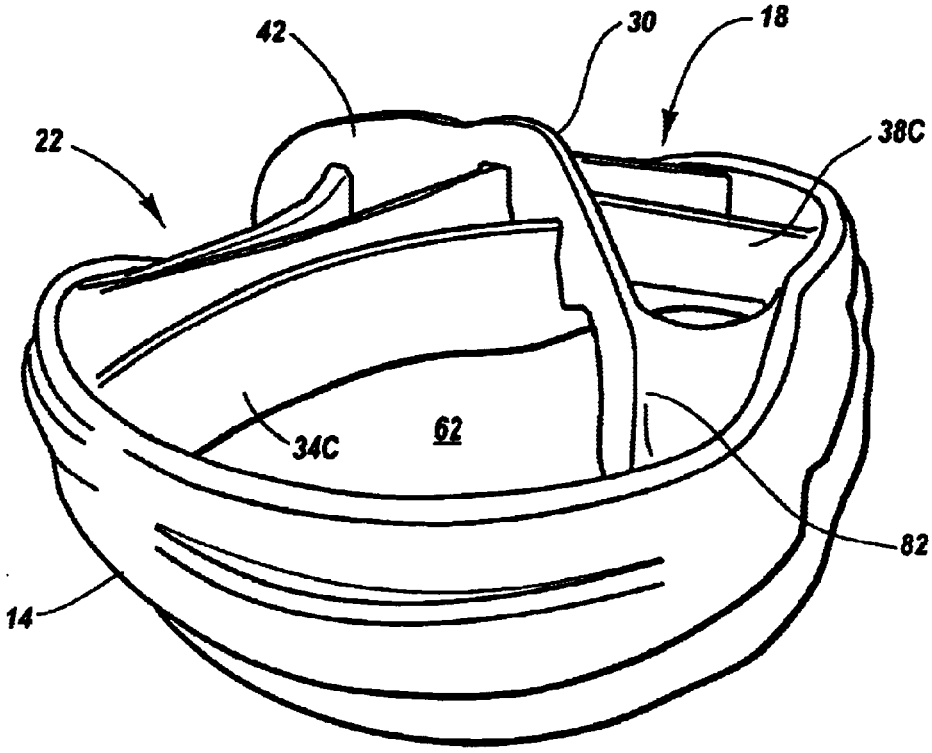
FIG. 6 illustrates a rear view of the golf bag top and club separator according to one embodiment of the present invention.

The present invention club separator 10 further comprises a perimeter rise 82 formed at the rear or back end of club separator 10. Specifically, perimeter support member 14 defines the perimeter or outermost edge of club separator 10 and comprises an uppermost portion having a perimeter rise 82 located therein at the juncture between wood complex 18 and iron complex 22 at the rear or back end of club separator 10 as shown in FIG. 6. Stated differently, the uppermost portion of perimeter support member 14 located along the side of wood complex 18 is offset at a heightened level from the uppermost portion of perimeter support member 14 running along the side of iron complex 22, wherein at the junction of wood complex 18 and iron complex 22, along perimeter support member 14, a step or a perimeter rise 82 is created, such that the uppermost portion of perimeter support member 14 at wood complex 18 is offset from the uppermost portion of perimeter support member 14 at iron complex 22. The function of perimeter rise 82 is to allow a greater amount of the golf clubs existing within "low" iron compartment 62 to be exposed, thus making them more accessible to the user. As is apparent from each of FIGS. 4–6, the present invention club separator 10 comprises a strategically designed perimeter support member 14 such that access to the clubs contained within club separator 10 are more readily accessible to the user.

Figure 2:
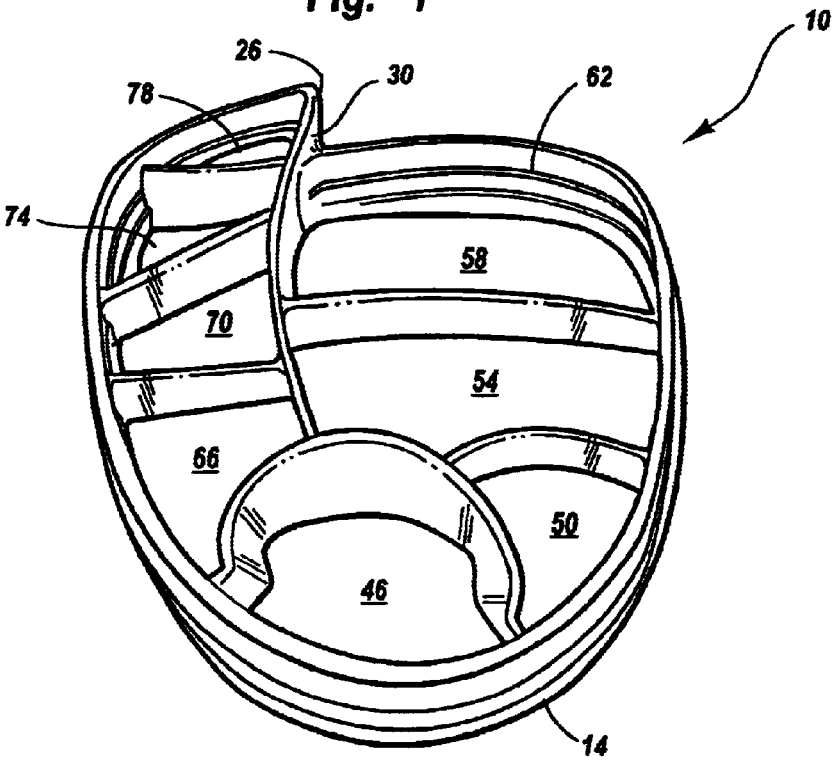
FIG. 2 illustrates an elevated front view of the golf bag top and club separator according to one embodiment of the present invention.

Referring back to FIG. 2, the present invention further features strategic placement of wood complex 18 relative to iron complex 22, as well as relative to putter complex 46 if implemented. Specifically, FIG. 2 shows wood complex 18 positioned at a location within perimeter support member 14 proximate to the body of the user of the golf bag. Conversely, lower end complex 22 is positioned within perimeter support member 14 at a distance from the body of the user further than wood complex 18. The relative positioning of wood complex 18 and iron complex 22 in this manner, in conjunction with the accessibility enabling features of perimeter support member 14 as discussed above, provides significant advantages over prior art club separator devices. For example, club separator 10 caters to the ergonomic limitations of a golfer while undertaking a round of golf. As the golf bag employing club separator 10 is utilized by a golfer during a round of golf, access to the desired club is greatly increased as a result of the design features discussed herein. To access an iron-type club, the user simply reaches around and into the area defined by iron complex 22 and retrieves a club therefrom. Little interference from any of the wood-type clubs within wood complex 18 is experienced. Likewise, to access and retrieve a wood-type club, the user simply reaches his hand across the iron-type clubs located in the iron, complex 22 to grasp and retrieve one of the clubs located in wood complex 18. Moreover, club separator 10 of the present invention facilitates an increased ability to remove clubs from both wood complex 18 and iron complex 22 as the clubs in iron complex 22 are incapable of contacting and intertwining with any-of the clubs in wood complex 18. In prior art designs, it is not uncommon for the club heads of the iron-type clubs to contact the shaft portion of the wood-type golf clubs, thereby making retrieval of either more difficult. Another advantage of the design of the present invention club separator 10, and particularly protective ridge 30 as found within wood/iron partition 26, is that there is a reduction in the likelihood that either the iron-type clubs or the wood-type clubs would become marred, scratched, or otherwise damaged as a result of their contact with one another. Prohibiting contact between the clubs therefore serves to preserve the life and aesthetic appeal of each of the golf clubs contained within the golf bag.

Referring now to FIG. 7, the ergonomic golf bag top and club separator of the present invention further comprises means for engaging and securing the perimeter support member to a golf bag 100, and particularly the top or upper 108 of the main body 104 of golf bag 100. Means for attachment may be any means commonly known in the art such as via screws, rivets, an interference fit, being sewn into main body 104, or other similar means. In another embodiment, means for engaging comprises a golf bag insert extending from the perimeter support member. The golf bag insert functions to insert into the upper opening of a golf bag to be secured therein. Upon inserting, a stopper is provided that engages an upper lip portion of the upper opening of the golf bag to ensure correct positioning of club separator 10 within golf bag 100.

FIG. 7 also shows the relative placement of club separator 10 within golf bag 100. Particularly, club separator 10 is positioned so that wood complex 18 is vertically segregated, yet directly adjacent or proximate the body of a user, as golf bag 100 is suspended of the shoulder of the user via means for carrying golf bag 100, such as a strap 116. FIG. 7 further illustrates how iron-type golf clubs 124, and particularly the heads of iron-type golf clubs 124, are less likely to contact the shaft portion of wood-type golf clubs 120 due to the protective barrier provided by wood/iron partition 26, and particularly protective ridge 30.

As is apparent from the disclosure corresponding to the figures described above, FIGS. 1–7, the golf bag top and club separator of the present invention comprises a wood complex proximate the body of a user. It should be noted however, that the wood complex described and explained herein may also be situated distal the body of the user, with its own advantages and benefits for doing so. What remains constant throughout these differing embodiments is the fact that the wood complex, and the golf clubs received and housed therein, are vertically segregated along the sides of the club separator, rather than at an end section as commonly found in prior art designs.

Figure 8:
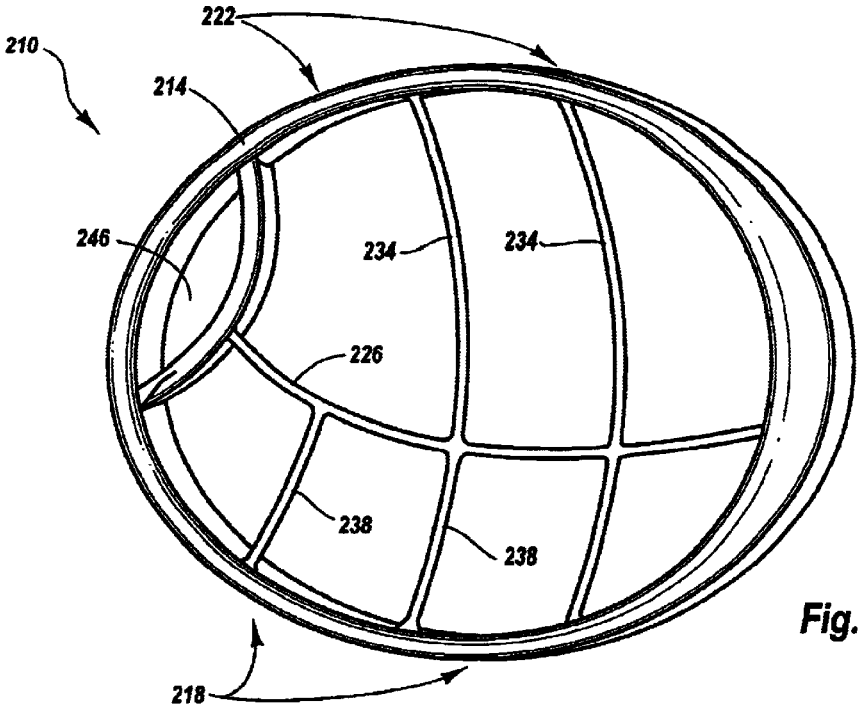
FIG. 8 illustrates an alternative embodiment, wherein the golf bag top and club separator of the present invention comprises a flat or substantially flat profile.

As stated, the present invention golf bag top and club separator also comprises other design configurations or embodiments in which the wood complex is vertically segregated. In another exemplary embodiment, as shown in FIG. 8, the present invention golf bag top and club separator 210 comprises a perimeter support member 214 having a relatively flat profile. In this embodiment, wood complex 218 is shown situated at a position distal the body of a user (see FIG. 11 also) and is opposite iron complex 222, each of which are adjacent putter complex 246. However, unlike the embodiment described above, club separator 210 comprises a relatively flat profile perimeter support member 214. Moreover, wood/iron partition 226 is congruent in elevation with each of wood dividers 238 and iron dividers 234 so that the upper most sections of each of these are flush. Dividers 238 and dividers 234 each extend substantially horizontally from one side of perimeter support member 214 to wood/iron complex 226. Wood complex 218 is also vertically segregated within perimeter support member 214 in order to allow for the benefits and advantages previously described herein.

Figure 9:
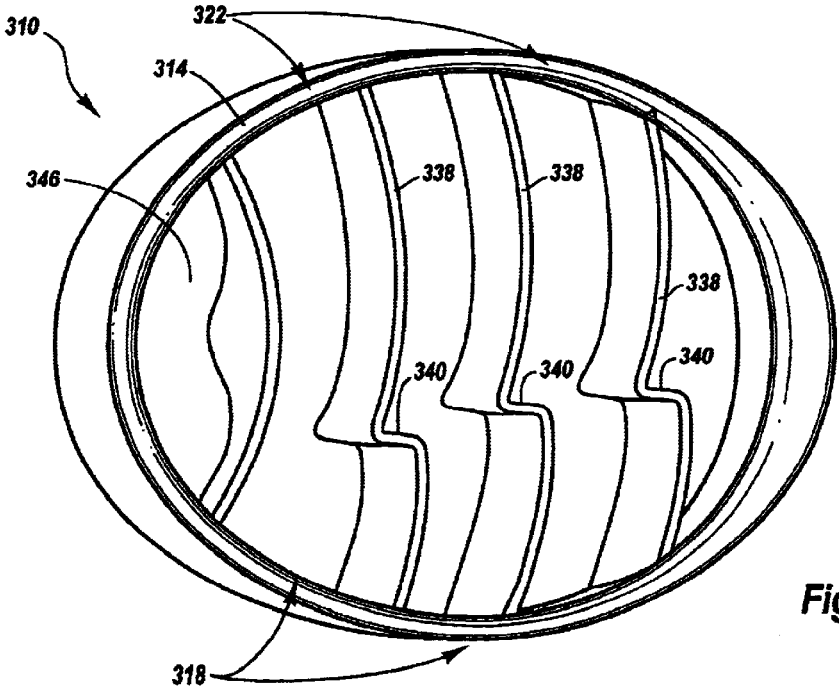
FIG. 9 illustrates an alternative embodiment, wherein the golf bag top and club separator of the present invention comprises plurality dividers having rises therein to define a wood complex and an iron complex.

FIG. 9 illustrates still another exemplary embodiment. Specifically, FIG. 9 illustrates golf bag top and club separator 310 having a perimeter support member 314. Perimeter support member 314 may further comprise a perimeter rise, but this is optional. In this particular embodiment, club separator 310 also comprises wood complex 318 vertically segregated or disposed within perimeter support member 314 and opposite or substantially opposite iron complex 322, as well as being positioned distal to the body of the user. Club separator 310 further comprises putter complex 346 situated therein. However, club separator 310 is shown having no wood/iron partition therein. Rather, club separator 310 comprises a series or a plurality of club dividers 338 extending horizontally from one side to another of perimeter support member 314, each comprising or possessing a divider rise 340 therein. These divider rises 340 may he formed to correspond to a perimeter rise (similar to perimeter rise 82 shown in FIG. 7), if made available in perimeter support member 314. Divider rises 340 are positioned along the longitudinal length of dividers 338 so that each of club dividers 338 comprise an elevated portion forward rise 340 and a lower portion aft rise 340 as illustrated in FIG. 9. Providing a series of two tiered dividers effectively creates a wood complex 318 that is substantially elevated from an iron complex 322, each being specifically positioned or situated within perimeter support member 314. Wood complex 318 remains vertically segregated at a position distal the user and opposite iron complex 322 (which is proximate the body of the user), but separated from iron complex 322 as a result of the rises 340 formed within club dividers 338.

Figure 10A:
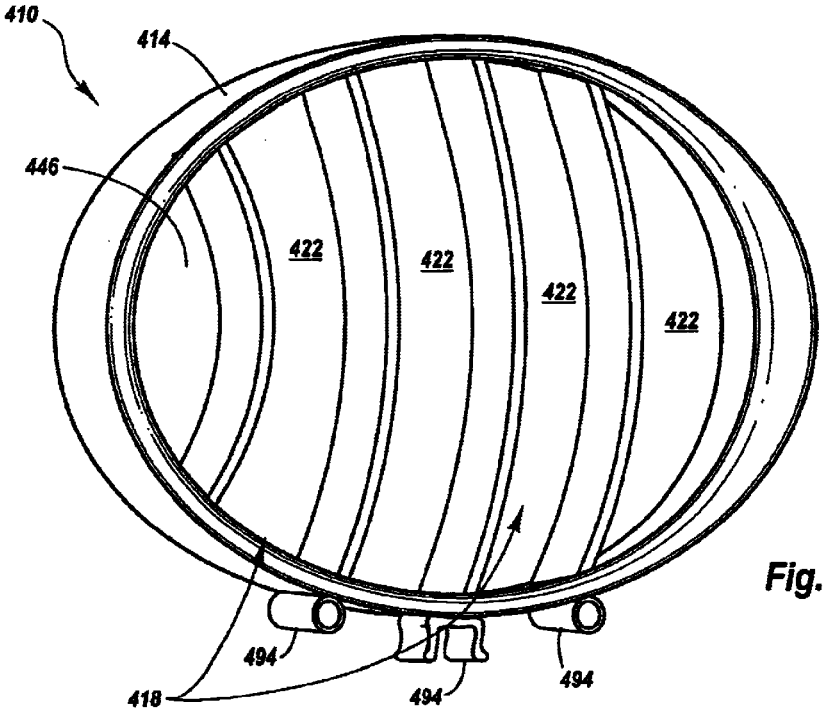
FIGS. 10*a* and 10*b* illustrate alternative embodiments, wherein the golf bag top and club separator of the present invention comprise a wood complex vertically segregated and positioned outside or without the perimeter support member.
Figure 10B:
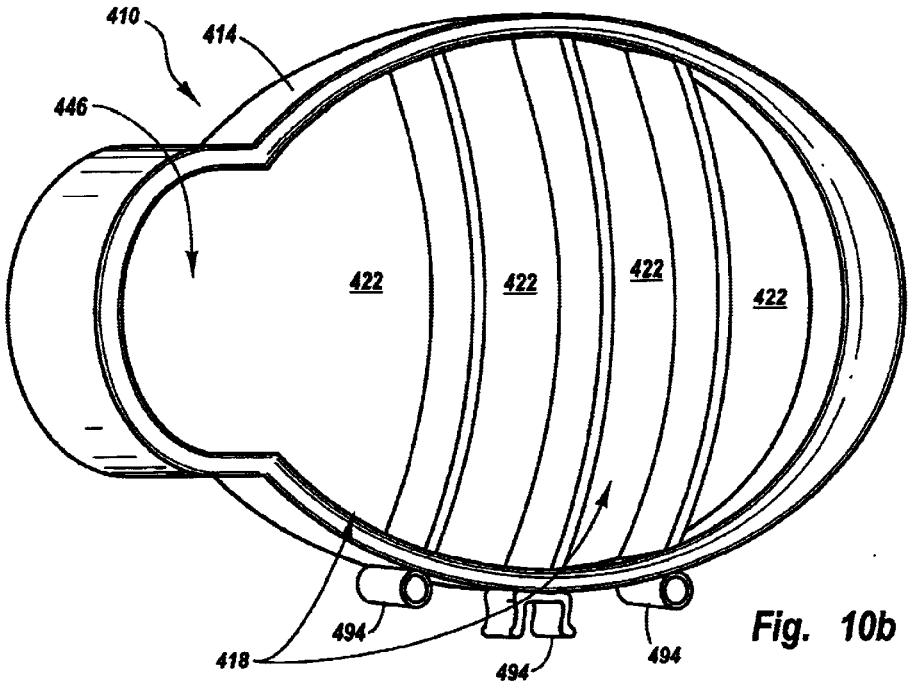

FIGS. 10*a* and 10*b* illustrate yet another alternative embodiment. Specifically, FIGS. 10*a* and 10*b* illustrate club separator 410 comprising a perimeter support member 414 having an iron complex 422, a wood complex 418, and a putter complex 446, each situated or positioned therein as shown. Iron complex 422 further comprises a plurality of dividers 434 extending horizontally from one side to another side of perimeter support member 414.

Club separator 410 further comprises a wood complex 418 vertically segregated and situated or disposed without the wall of perimeter support member 414. However, wood complex 418 is situated along the vertical of side of perimeter support member 414 so as to allow for similar vertical segregation of any wood-type golf clubs placed therein as described previously above.

Wood complex 418 further comprises means 494 for receiving and retaining or securing a golf club. Means for receiving and securing a golf club comprises any known means in the art, particularly a plurality of tubes or tube-like structures that are securely coupled to perimeter support member 414 and that are capable of receiving a golf club therein and providing support for the golf club. In another embodiment, means 494 for receiving and securing may comprise a plurality of clips that can securely engage either a shaft or head portion of a golf club. Still further, means 494 may comprise a series of dividers extending outward from perimeter support member 414, which are further enclosed by an extended support member defining an area of wood complex 418. These structures or devices are commonly known in the art and are merely exemplary of three of several possible means 494 that may be employed to receive and vertically segregate and secure a golf club within wood complex 418 situated without or outside perimeter support member 414 as shown in FIG. 10.

It should be noted that club separator 10 may comprise still other configurational embodiments not specifically mentioned, recited, described, shown, or claimed herein. Specifically, the particular placement and positioning of wood complex 18 relative to iron complex 22, the angling and incline of wood dividers 38 and iron dividers 34, the degree of offset between wood complex 18 and iron complex 22, and the height and location of wood/iron partition 26 and perimeter rise 82 will be obviously to one ordinarily skilled in the art. As such, the description presented in the corresponding Figures discussed herein should not be considered limiting in any way. Moreover, it should also be noted that the golf bag top and club separator described herein, along with its elements and features, may be positioned in reverse to accommodate left hand users.

Figure 11:
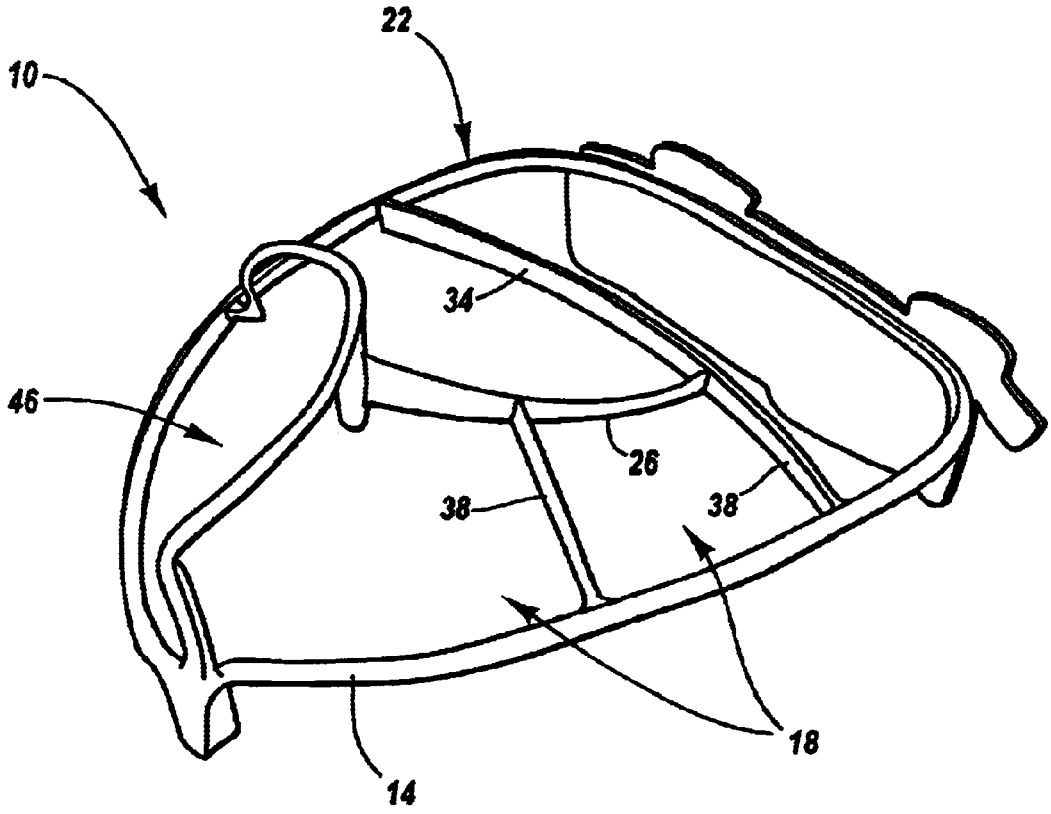
FIG. 11 illustrates another embodiment, wherein the golf bag top and club separator is comprised of a lightweight construction.

FIG. 11 illustrates golf bag top and club separator 10 comprised of a light weight construction. In this embodiment, wood complex 18 is vertically segregated and substantially opposite iron complex 22. Also, there are less wood dividers 38 and iron dividers 34 separating or dividing the area of perimeter support member 14, indicating that the club separator shown in this embodiment may be manufactured for utilization on a golf bag designed for children.

Figure 12:
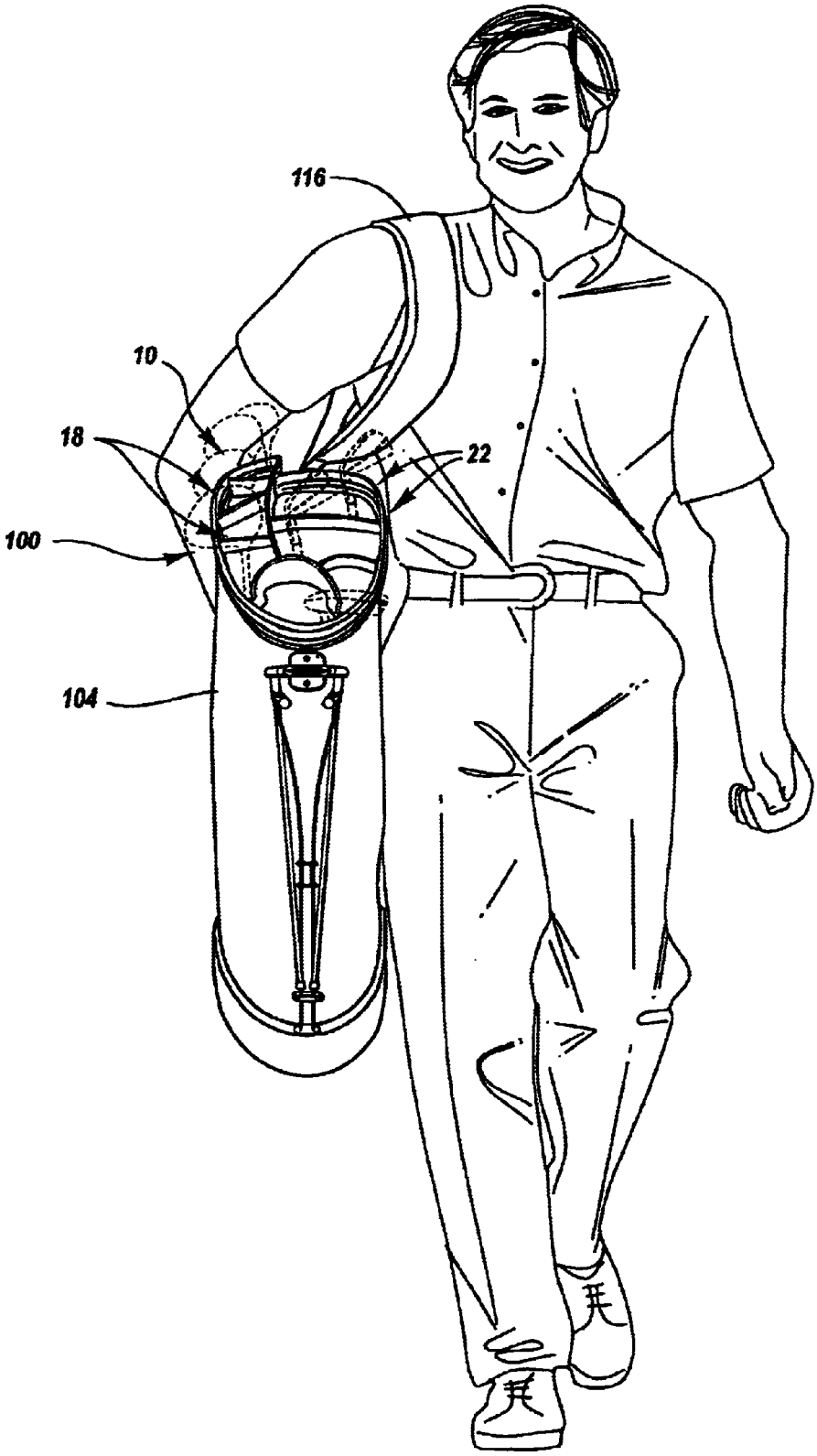
FIG. 12 illustrates the golf bag top and club separator of the present invention in use as being securely coupled to a golf bag and carried by the user.

FIG. 12 illustrates golf bag top and club separator 10 as it is attached or used with a golf bag 100. Club separator 10 is shown comprising a wood complex 18 that is vertically segregated and opposite iron complex 22, as well as being positioned distal to the body of the user. Of course, as explained earlier, wood complex may be positioned proximate the user. As the user straps-on the golf bag, the ergonomically designed club separator 10 allows the user to more efficiently and conveniently access and retrieve both the iron-type and wood-type golf clubs housed within golf bag 100, as previously described herein.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A golf bag top and club separator comprising:

a perimeter support member defining an area for placement of golf clubs, said perimeter support member comprising:

an elevated rear section;

a lower front section integrally formed with said elevated rear section;

a perimeter rise located along said rear portion, said perimeter rise allowing a greater portion of a golf club placed adjacently within said perimeter support member to be exposed, thus providing more ergonomic access to said golf club; and a plurality of dividers intermittently spaced within said perimeter support member and extending from a first side to a second side of said perimeter support member, said dividers comprising a rise therein substantially corresponding to said perimeter rise, wherein an elevated wood complex is defined aft said rise, and a lower iron complex is defined forward said rise, said elevated wood complex being vertically segregated within said perimeter support member.

2. A golf bag top comprising:

a perimeter support member; and a horizontal divider substantially parallel to the ground when being carried; said horizontal divider having a substantially straight portion at each end, the two ends being nonlinear and having there between a curved portion stepping down between the two straight portions so as to hinder the movement of a golf club from the lower straight portion to the upper straight portion thereby substantially partitioning the clubs on one side of the golf bag from moving to the other side of the golf bag.

3. An ergonomic golf bag top and club separator comprising:

a perimeter support member having a profile and periphery so as to provide optimal wood and iron separation as well as optimal ergonomic club access;

a wood complex for housing wood-type golf clubs, said wood complex being vertically segregated and oriented within said perimeter support member so as to allow similar vertical segregation of wood-type golf clubs received and housed therein, said elevated wood complex contouring to said profile and comprising a plurality of wood dividers therein to define a plurality of wood compartments along one side of the bag;

an iron complex positioned within said perimeter support member for housing iron-type golf clubs, said iron complex providing a plurality of iron dividers therein to define a plurality of iron compartments; and a wood/iron partition separating a portion of said elevated wood complex from a portion of said lower iron complex in an offset manner, said wood/iron partition comprising a protective ridge extending from said wood complex to said iron complex, said wood/iron partition reducing contact between any iron-type golf clubs housed within said iron complex and any wood-type golf clubs housed within said wood complex, and wherein said wood/iron partition intersects with said perimeter support member and extends therefrom to a putter complex.

4. An ergonomic golf bag top and club separator comprising:

a perimeter support member having a first side substantially corresponding to a rim of a golf bag, and a second substantially planar side that segregates an iron complex from a wood complex;

said iron complex disposed within said perimeter support member and comprising a plurality of dividers extending between said first and second sides of said perimeter support member segregating said iron complex;

said wood complex situated without said perimeter support member, said wood complex adapted to provide substantially planar vertical segregation and disposition of wood-type golf clubs, said wood complex comprising means for receiving and securing a golf club; and a putter complex supported at least in part by said perimeter support member.

5. The ergonomic golf bag top and club separator of claim 4, wherein said means for receiving and securing a golf club comprises one or more clip-in structures that securely couple a head or shaft portion of said golf club.

6. The ergonomic golf bag top and club separator of claim 4, wherein said wood complex is located distal said user.

7. The ergonomic golf bag top and club separator of claim 4, wherein said putter complex is situated and positioned without said perimeter support member.

8. The ergonomic golf bag top and club separator of claim 4, wherein said a putter complex is situated and positioned within said perimeter support member.

9. A golf bag top comprising:

a perimeter support member having a profile and periphery so as to provide optimal wood and iron separation as well as optimal ergonomic club access, said ergonomic profile extending from a high point to low point;

an elevated wood complex for housing wood-type golf clubs, said wood complex being oriented within said perimeter support member so as to allow substantially planar vertical segregation of wood-type golf clubs received and housed therein, said elevated wood complex substantially corresponding to said profile and comprising a plurality of wood dividers therein to define a plurality of wood compartments along one side of the bag;

an iron complex positioned within said perimeter support member for housing iron-type golf clubs, said iron complex providing a plurality of iron dividers therein to define a plurality of iron compartments, and a putter complex partially defined by one of said iron dividers at the lowest point on the profile; and a wood/iron partition separating said perimeter support member into said elevated wood complex and said iron complex of different sizes, said partition supporting said wood dividers and said iron dividers, further separating a portion of said elevated wood complex from a portion of said lower iron complex in an offset manner, said wood/iron partition comprising a protective ridge extending from said wood complex to said iron complex, said wood/iron partition reducing contact between any iron-type golf clubs housed within said iron complex and any wood-type golf clubs housed within said wood complex, and wherein said wood/iron partition intersects with said perimeter support member and extends therefrom to said putter complex.

* * * * *